US006168154B1

(12) United States Patent
Asahara et al.

(10) Patent No.: US 6,168,154 B1
(45) Date of Patent: Jan. 2, 2001

(54) SHEET HANDLING DEVICE FOR CONTINUALLY FED SHEETS WHICH ARE ALIGNED AND MOVED FROM FIRST TO SECOND STORAGE LOCATIONS

(75) Inventors: Tsuyoshi Asahara, Yamanashi-ken; Hirofumi Kaneko, Kofu; Kazuaki Sano, Yamanashi-ken; Takashi Saito, Sakaigawa-mura; Hideki Mimura, Yamanashi-ken, all of (JP)

(73) Assignee: Nisca Corporation Yamanashi-ken (JP)

( * ) Notice: Under 35 U.S.C. 154(b), the term of this patent shall be extended for 0 days.

(21) Appl. No.: 09/085,266

(22) Filed: May 26, 1998

(30) Foreign Application Priority Data

May 26, 1997 (JP) ..... 9-153031
Nov. 18, 1997 (JP) ..... 9-333464

(51) Int. Cl.[7] ..... B65H 9/04

(52) U.S. Cl. ..... 271/245; 271/220; 271/221; 414/789; 414/788.9; 270/58.12

(58) Field of Search ..... 271/220, 221; 414/789, 789.1, 788.9; 270/58.12, 58.11, 58.27, 58.16

(56) References Cited

U.S. PATENT DOCUMENTS 1,865,308 * 6/1932 Evans et al. ..... 271/221
2,235,347 * 3/1941 Zahutnik ..... 414/789 X
3,777,903 * 12/1973 Kuckhermann ..... 414/789
3,866,741 * 2/1975 Carbond et al. ..... 414/789
4,867,436 * 9/1989 Hanada et al. ..... 271/221
5,080,342 * 1/1992 Mori et al. ..... 270/58.11
5,096,370 * 3/1992 Mohr ..... 414/789.1
5,217,215 * 6/1993 Ohata et al. ..... 270/58.16 X
5,382,016 * 1/1995 Kobayashi et al. ..... 271/221 X
5,439,344 * 8/1995 Yoshizuka et al. ..... 414/789.01
5,556,251 * 9/1996 Hiroi et al. ..... 271/221 X
5,799,935 * 9/1998 Yamanushi et al. ..... 270/58.27 X

FOREIGN PATENT DOCUMENTS 4-290800 10/1992 (JP) .
6-321418 11/1994 (JP) .

* cited by examiner

*Primary Examiner*—Kenneth W. Noland
*Assistant Examiner*—Richard Ridley
(74) *Attorney, Agent, or Firm*—Pitney, Hardin, Kipp &Szuch LLP

(57) ABSTRACT

A sheet handling device for accommodating, aligning and storing sheets fed from an image forming apparatus such as a copying machine is provided with front-side and rear-side aligning members for pressing the sheets stacked on a first storage means between the aligning members to stably and exactly align the stacked sheets. The front side aligning member is movable vertically or rotatable to open a sheet transferring passage so as to enable a sheet aligning mechanism in the sheet handling device to be operated in a small space, and thus, made compact. While transferring the aligned sheets from the first storage means to a second storage means, the aligned sheets are stably held by the front-side aligning member being in soft contact with the upper surface of the sheets being transferred.

17 Claims, 12 Drawing Sheets

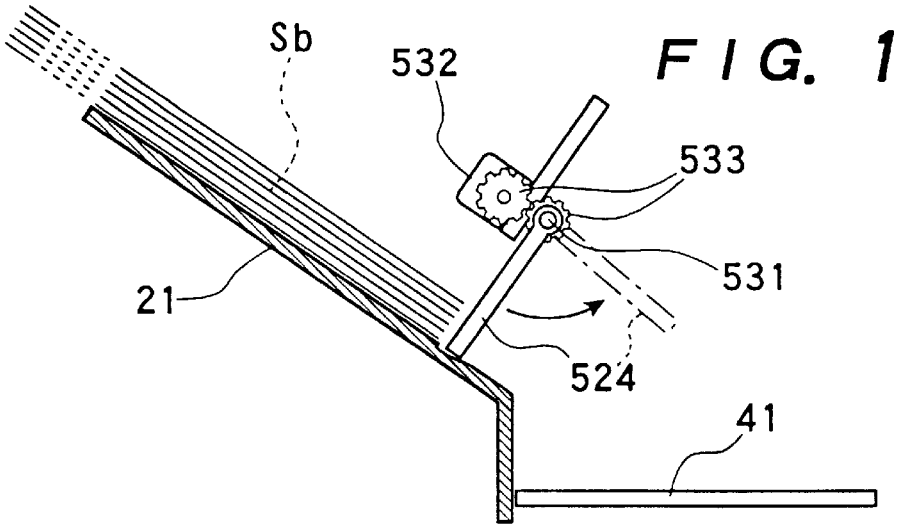
FIG. 14
FIG. 15A
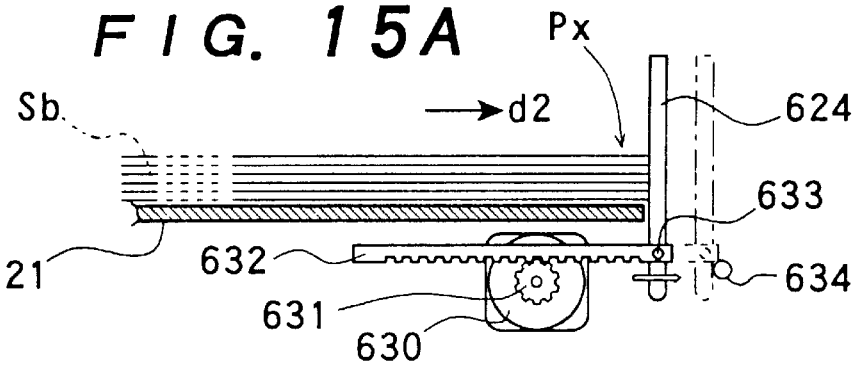
FIG. 15B
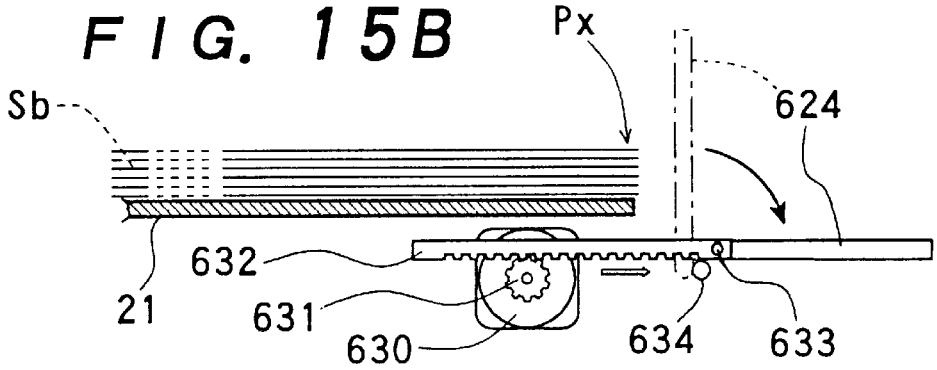

SHEET HANDLING DEVICE FOR CONTINUALLY FED SHEETS WHICH ARE ALIGNED AND MOVED FROM FIRST TO SECOND STORAGE LOCATIONS

BACKGROUND OF THE INVENTION

1. Field of the Invention

This invention relates to a sheet handling device for stably accommodating, aligning and storing sheets fed from an image forming apparatus such as a copying machine.

2. Description of the Prior Art

Sheet handling devices for automatically sorting, binding and storing recorded sheets continuously discharged from an image forming apparatus such as a copying machine, printer, and facsimile have been used.

A conventional sheet handling device of this type has been known, in which sheets continuously fed from the image forming apparatus are sorted and distributed into bin trays to form sheaves of sheets in the bin trays, and then, the sheaves of sheets are bound with staples as occasion calls (Japanese Patent Application Public Disclosure No. 4-290800(A)). There has been known another sheet handling device having a sheet processing section for binding sheets continuously fed from the image forming apparatus, and a sheet storing section for stacking the bound sheets, which sections are placed side by side (Japanese Patent Application Public Disclosure No. 6-9142(A)).

In both the known sheet handling devices, the sheets which are continuously sent from the image forming apparatus into the sheet processing section and stacked in a sheaf undergo post-processing such as stapling and punching. Prior to carrying out the post-processing, the sheets are aligned to true up the edges thereof.

The sheets fed from the image forming apparatus are first stacked on a stacking tray or bin tray. The stacking tray inclines one side as seen in the aforesaid prior art references, so that the sheets placed thereon spontaneously slide down the inclined plane of the stacking tray until striking against a transferring reference surface defined at the lowermost of the inclined plane of the stacking tray, consequently to true up the edges of the sheets.

That is, in the most conventional sheet handling devices, the sheets are automatically aligned in one direction, but must be forcibly aligned by using some means in the direction perpendicular to that in which the sheets are automatically aligned. For that purpose, the aforementioned prior art device has sheet aligning levers disposed one before and behind the sheet stacking tray relative to a sheet discharging direction, which are rockingly rotatable in parallel to the surface of the stacking tray. The sheets on the stacking tray are pinched between the two sheet aligning levers so as to be aligned in the sheet discharging direction.

As a result, a sheet aligning mechanism having the sheet aligning levers become inevitably large in size because it calls for a large space for permitting the two sheet aligning levers to move rockingly. Furthermore, the sheet aligning mechanism having the sheet aligning levers suffers a disadvantage such that it necessitates a high-power driving system capable of producing large rotating torque for imparting sufficient pinching force to the aligning levers so as to exactly align the sheets between the levers. Besides, there is an inconvenient possibility that the sheet aligning levers cause the sheets to be stacked unevenly when parting from the sheets.

In addition, when the sheets aligned are transferred before being bound with a staple, the sheets are unlikely to be exactly heaped up. However, the conventional sheet aligning mechanism is not provided with means for preventing the sheets from straggling, thus disadvantageously causing jamming of the sheets being transferred or failure to staple the sheets.

OBJECT OF THE INVENTION

An object of the present invention is to provide a sheet handling device capable of securely and effectively aligning sheets fed from an image forming apparatus such as a copying machine so as to true up the edges of the sheets exactly.

Another object of the present invention is to provide a sheet handling device capable of effectively aligning sheets fed from an image forming apparatus into a sheaf of sheets and reliably sending out the sheaf of sheets without disturbing or stacking unevenly the sheets thus aligned.

Still another object of the invention is to provide a sheet handling device having the outstanding ability to securely and effectively align the given sheets, which is relatively simple in structure and has components operable in a narrow space, thus enabling the device to be made small in size.

Yet another object of the invention is to provide a useful sheet handling device which can be applied to or incorporated into not only an image forming apparatus such as a copying machine, facsimile and printer, but also all sorts of apparatuses handling a sheet or sheets.

SUMMARY OF THE INVENTION

To attain the objects described above according to this invention, there is provided a sheet handling device comprising a first storage means for storing one or more sheets, means for transferring the sheets stored in the first storage means, a second storage means for storing the sheets transferred from the first storage means by the transferring means, sheet aligning means to be brought into collision with the leading edges of the sheets relative to the sheet discharging direction in which the sheets are transferred so as to align the sheets stacked on the first storage means, thus truing up the leading edges of the sheets, and moving means for causing the sheet aligning means to be retracted from its sheet aligning position at which the sheets are aligned by the sheet aligning means in the direction perpendicular to the upper surface of the sheets being transferred.

A sheet transferring passage along which the sheets are sent out from the first storage means is formed in the sheet discharging direction perpendicular to a sheet introducing direction in which the sheets are fed from the image forming apparatus to the first storage means. The second storage means is placed in juxtaposition to the first storage means relative to the sheet discharging direction, so that the sheets aligned on the first storage means are transferred to the second storage means in the sheet discharging direction.

The sheet aligning means comprises a rear-side aligning member placed behind the first storage means relative to the sheet discharging direction, and a front-side aligning member placed before the first storage means and opposed to the rear-side aligning member.

The front-side aligning member retractably confronting the front end of the first storage means so as to open and close the sheet transferring passage defined in the first storage means. In order to selectively allow and block the passage of the sheets through the front-side aligning member, the front-side aligning member may be moved vertically or rotated forwardly in the sheet discharging direction.

When a prescribed number of sheets stacked on the first storage means are aligned in the sheet discharging direction, the front-side aligning member assumes its lower aligning position, and then, the rear-side aligning member is moved forward in the sheet discharging direction. Consequently, the sheets on the first storage means are pressed against the front-side aligning member by the rear-side aligning member to be aligned in the sheet discharging direction.

After the sheets are pinched and pressed between the front-side aligning member and the rear-side aligning member so as to be aligned, they are held by the transferring means, moving the front-side aligning member out of the sheet transferring passage and returning the rear-side aligning member to its home position. The sheets thus released from the front-side and rear-side aligning members are sent out by the sheet transferring means in the sheet discharging direction to the second storage means.

In the process of transferring the sheets from the first storage means to the second storage means, the sheets are stapled or punched.

In the case of using the front-side aligning member movably vertically, the front-side aligning member may be brought in soft contact with the upper surface of the sheets being transferred from the first storage means to the second storage means, so that the sheets passing under the front-side aligning member is softly pressed down by the front-side aligning member so as to be stably transferred to the second storage means without straggling.

To withdraw the front-side aligning member from the sheet transferring passage after pinching the sheets between itself and the rear-side aligning member to align the sheets, the front-side aligning member may be moved upward at an angle in the sheet discharging direction so as not to come in contact with the edges of the sheets aligned between the front-side and rear-side aligning members. As a result, when the front-side aligning member which has pressed the sheets in conjunction with the rear-side aligning member is withdrawn from the sheet transferring passage, it is not rubbed against the leading edges of the sheets on the first storage means, so that the sheets can be sent onto the second storage means, while being remained in its stably aligned state without disturbing the leading edges of the sheets.

The front-side aligning member may be rotatably supported at the vicinity of the front end portion of the first storage means so as to rotate downward in the sheet discharging direction to retreat from the sheet transferring passage.

Other objects and features of the present invention will be hereinafter explained in detail with reference to the accompanying drawings.

BRIEF DESCRIPTION OF THE DRAWINGS

FIG. 14 is a schematic side view showing a sixth embodiment of the front-side aligning member.

FIG. 15A and FIG. 15*b* are schematic side views showing a seventh embodiment of the front-side aligning member.

DESCRIPTION OF THE PREFERRED EMBODIMENTS

Figure 1:
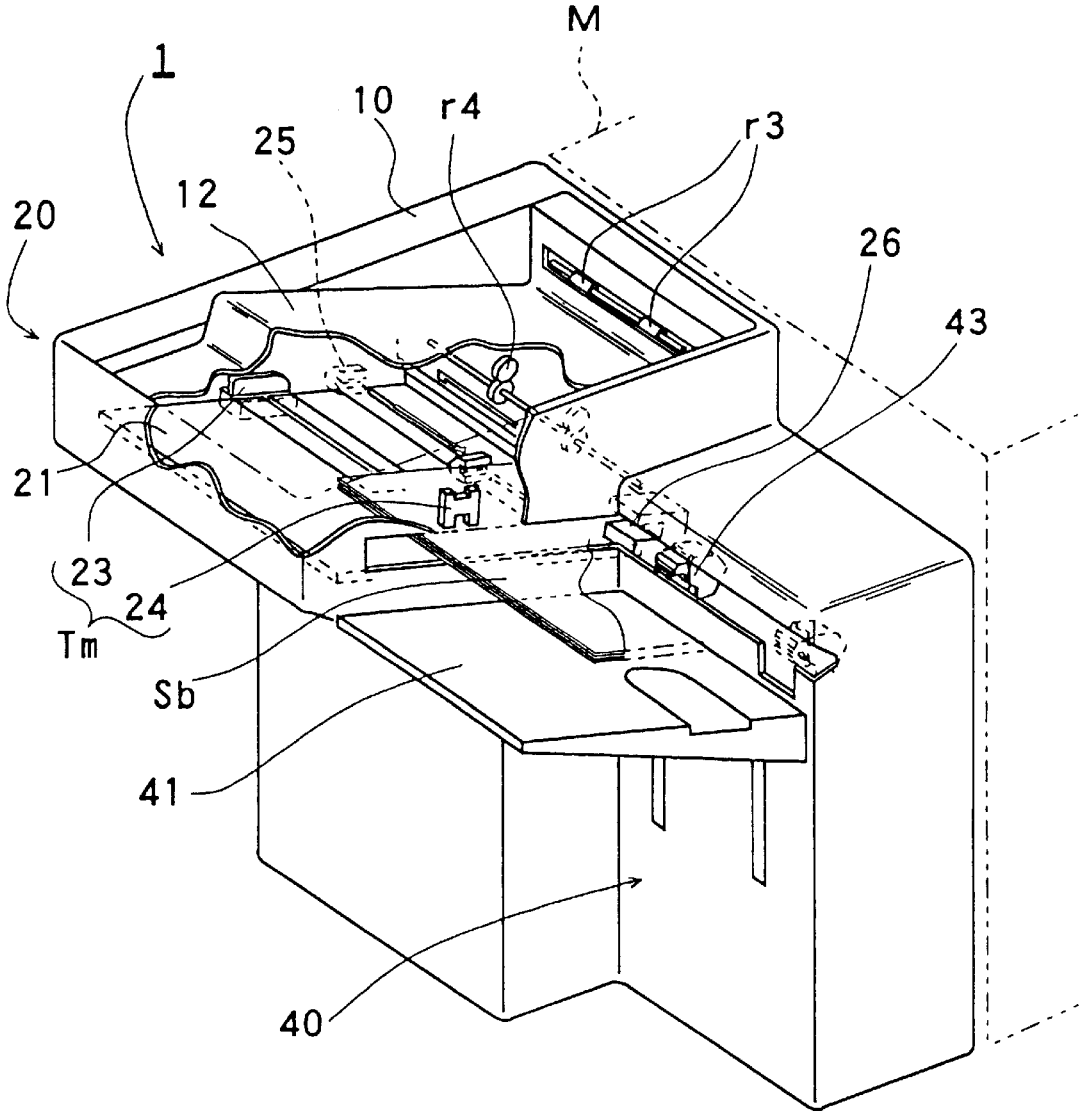
FIG. 1 is a partially cutaway perspective view showing one embodiment of a sheet handling device according to this invention.

This invention pertains to a sheet handling device applicable to an image forming apparatus such as a copying machine and having functions of aligning sheets continuously fed from the image forming apparatus and stapling or punching and storing the sheets with high efficiency. One embodiment of the sheet handling device according to this invention will be described with reference to the accompanying drawings.

The sheet handling device 1 of this invention is united with the image forming apparatus M in use in such a state that a sheet inlet port 10*a* formed in a housing 10 is joined to a sheet outlet port m of the image forming apparatus M. In addition to the copying machine touched upon above, a printer and facsimile are typical of the image forming apparatus, but the type of the apparatus to which this invention is applied is not specifically limited thereto. This invention can be applied to various sorts of sheet handling devices including a printing press, bookbinding device and so on.

The sheet handling device 1 of this embodiment according to the invention comprises a sheet processing section 20 in which one or more sheets s (s1, s2) fed from the image forming apparatus M are accommodated, aligned and bound into a sheaf of sheets Sb, and a sheet storing section 40 for storing one or more sheaves of sheets produced by the sheet processing section 20. The sheet processing section 20 is placed beside the sheet outlet port m of the image forming apparatus M relative to a sheet introducing direction d1. The sheet storing section 40 is juxtaposed with the sheet processing section 20 relative to a sheet discharging direction d2 across to the sheet introducing direction d1.

A sheet transferring passage Px extends over the sheet processing section 20 and the sheet storing section 40 in the sheet discharging direction d2.

There is formed an inclined top tray 12 on the upper surface of the housing 10 of the sheet processing section 20.

When there is no call for subjecting the sheet fed from the image forming apparatus to any post-processing, the sheet s1 is sent from the sheet inlet port 10*a* to the top tray 12 through a sheet passage p1.

In the case of aligning and binding sheets continuously fed from the image forming apparatus M, the sheet s2 is sent to the sheet processing section 20 through a sheet passage p2. At a diverging point of the sheet passages p1 and p2, a switching flap 14 is disposed so as to send the sheet fed from the image forming apparatus M selectively to the top tray 12 via the sheet passage p1 or the sheet processing section 20 via the sheet passage p2 in accordance with the operation mode prescribed at the image forming apparatus. Reference symbols r1 to r4 denote feed rollers mounted on the sheet passage extending from the sheet inlet port 10.

The sheet processing section 20 includes a first storage means 21 for stacking sheets fed from the image forming apparatus M thereon, a rear-side aligning member 23 for pushing the sheets on the first storage means 21 in the sheet discharging direction d2 so as to align the sheets, a front-side aligning member 24 movable vertically ahead of the rear-side aligning member 23 relative to the sheet discharging direction d2, a sheet transferring means 25 for sending out the sheets aligned on the first storage means 21 along the first storage means, and stapling means 26 for binding the margin part of the sheaf of sheets on the first storage means 21 with one or more staples. In particular, the rear-side aligning member 23 and the front-side aligning member 24 constitute a sheet aligning mechanism Tm.

The first storage means 21 in this embodiment is a stacking tray for accommodating thereon the sheets fed from the image forming apparatus, which is located beneath an exit of the sheet passage p2 and inclined upward in the sheet introducing direction d1. The first storage means 21 has a sheet transferring reference surface 21*a* which stands upright relative to the surface of the stacking tray at the lowermost rear end of the stacking tray. Thus, a sheet fed from the image forming apparatus onto the first storage means spontaneously slides down the inclined surface of the first storage means in the direction opposite to the sheet introducing direction until striking against the sheet transferring reference surface 21*a*, consequently to align the sheets with the sheet transferring reference surface.

The front-side aligning member 24 disposed at the front end of the first storage means 21 relative to the sheet discharging direction d2 is moved up and down so as to selectively block the passage of the sheaf of sheets Sb.

The rear-side aligning member comprises an aligning operation member 23*a* which stands upright relative to the first storage means 21 and is movable to and fro in the sheet discharging direction p2 along the surface of the first storage means 21, a pair of guide rails 23*b* arranged under the stacking tray of the first storage means 21 and extending in the sheet discharging direction p2, rollers 23*c* movable along the guide rails 23*b*, a member 23*d* for connecting the rollers 23*c* with the aligning operation member 23*a*, and means 23*e* for driving the rollers 23*c* to move the aligning operation member to and fro along the guide rails 23*b*.

The first storage means 21 has a guide slot 21*b* extending in the sheet discharging direction d1 so as to guide the aforementioned connecting member 23*d* in one direction. By operating the driving means 23*e* which generally comprises an endless belt and pulleys, the rollers 23*c* are movable along the guide rails 23*b* to move the aligning operation member 23*a* to and fro in the sheet discharging direction d2.

Figure 5:
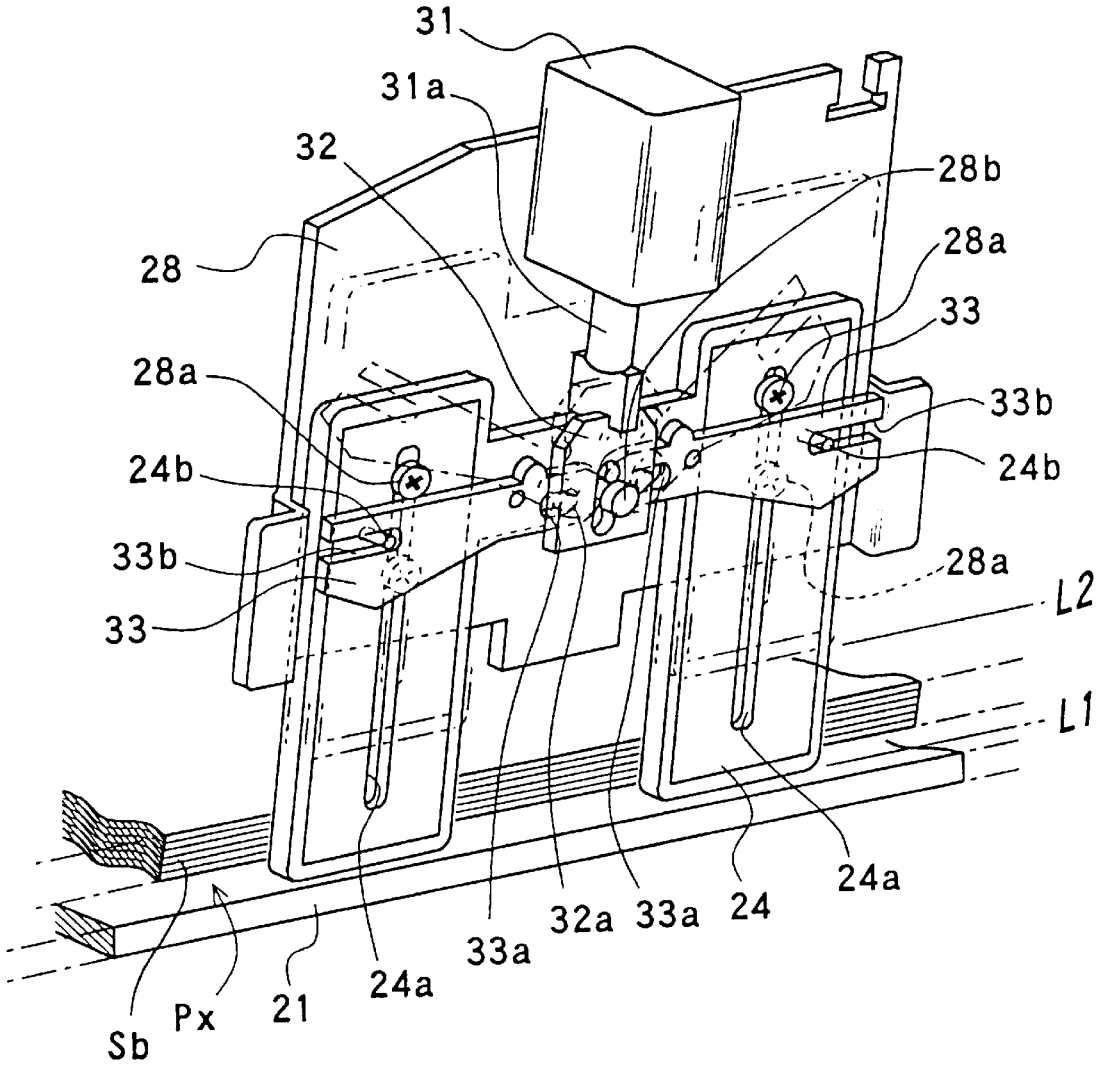
FIG. 5 is a perspective view showing a first embodiment of a front-side aligning member of a sheet aligning mechanism in this invention.
Figure 6A:
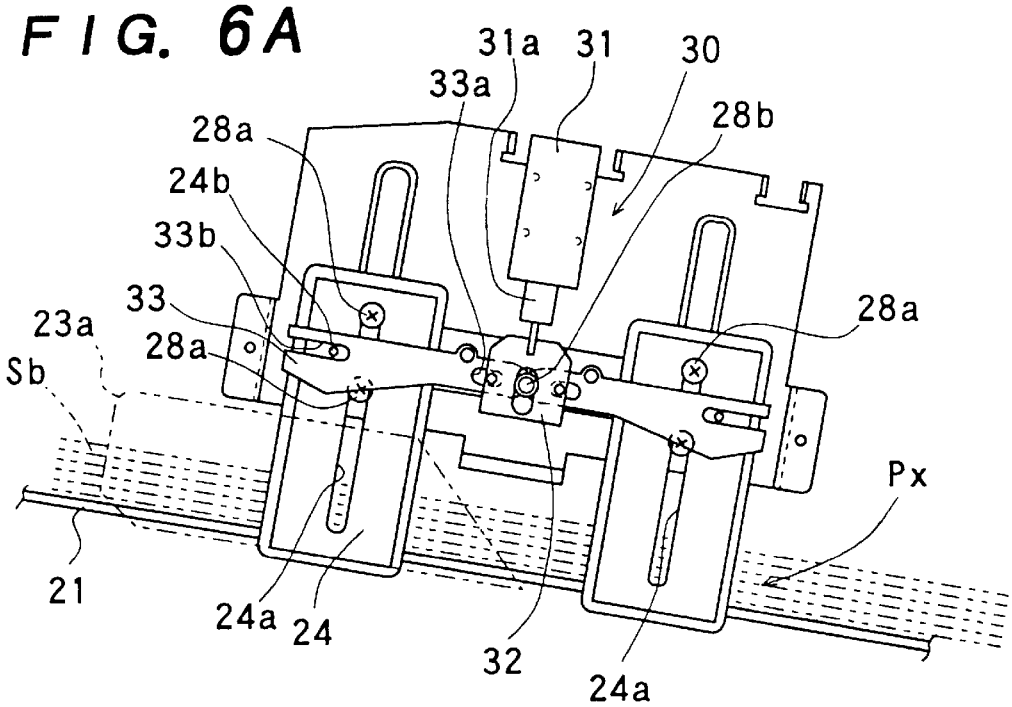
FIG. 6A is a front view showing the aligning operation of the front-side aligning member of FIG. 5.
Figure 6B:
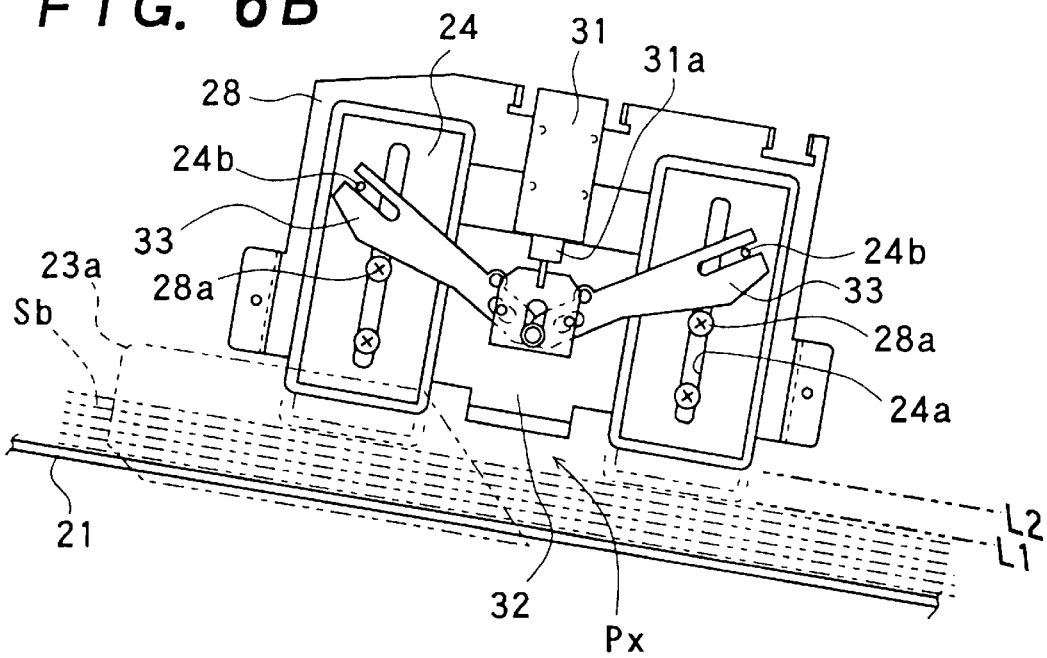
FIG. 6B is a front view showing the retreating operation of the front-side aligning member of FIG. 5.

The front-side aligning member 24 in this embodiment is formed of a shutter shaped in a substantial H-shaped as shown in FIG. 5 and FIGS. 6A and 6B, and has guide slots 24*a* receiving guide pins 28*a* planted on a supporting frame 28 retained by the device body, thus being supported movably vertically by the supporting frame 28.

The front-side aligning member 24 is withdrawn from the sheet transferring passage Px by actuating means 30 which comprises a solenoid 31 having a reciprocating rod 31*a*, a work member 32 connected to the reciprocating rod 31*a*, and a pair of rocking members 33 each movable rockingly about a rotation pin 28*b* with the vertical movement of the work member 32.

The work member 32 of the solenoid 31 is provided on its both sides with work pins 32*a* fitted respectively into work slots 33*a* formed in the rocking members 33. The rocking members 33 each have a slide slot 33*b* receiving a slide pin 24*b* planted on the shutter member 24.

Thus, when the solenoid 31 is actuated to stick the reciprocating rod 31*a*, the rocking members 33 move downward while rotating around the rotation pins 28*b* as shown in FIG. 6A. Consequently, the shutter member 24 assumes its lower aligning position L1 to close the sheet transferring passage Px formed on the upper surface of the first storage means 21.

Conversely, when the rocking members 33 rotate upward around the rotation pins 28*b* with the upward movement of the reciprocating rod 31*a* of the solenoid 31 as shown in FIG. 6B, the shutter member 24 moves upward to its retreating position L2 apart from the sheet transferring passage Px.

Figure 7A:
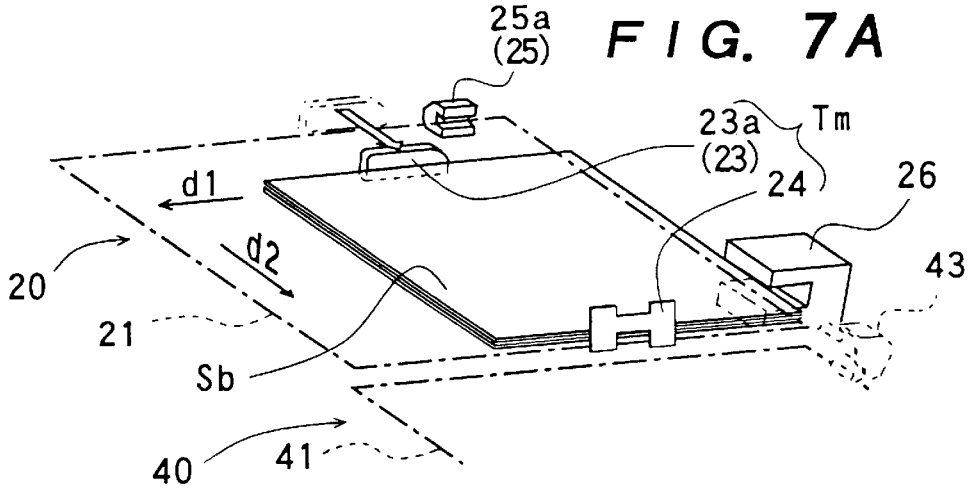
FIG. 7A through FIG. 7C are schematic perspective views explanatory of one operating mode of the front-side aligning member of FIG. 5.

To true up the leading and tail edges of the sheets stacked on the first storage means 21 in the sheet discharging direction, the front-side aligning member 24 disposed at the front end of the first storage means 21 is brought to its closed state (L1) as shown in FIG. 6A, and then, the aligning operation member 23*a* of the rear-side aligning member is moved forward in the sheet discharging direction d2 as shown in FIG. 7A. As a result, the sheets Sb stacked on the first storage means are pressed against the front-side aligning member 24, thus to be aligned in the sheet discharging direction.

The sheet transferring means 25 for sending the sheets Sb thus aligned and stored in the first storage means 21 to the sheet storing section 40 comprises means 25*a* for gripping the rear part of the sheaf of sheets relative to the sheet discharging direction d2, driving means 25*b* for rendering sheet gripping of the gripping means 25*a*, a pair of guide rails 25*c* disposed under the upper surface of the first storage means 21 and extending in the sheet discharging direction d2, rollers 25*d* movable along the guide rails 25*c*, and another driving means 25*e* for moving the rollers 25*d* to and fro along the guide rails 25*c* in the sheet discharging direction d2.

The gripping means 25*a* has upper and lower claws between which the sheets Sb stacked on the first storage means 21 are gripped, so that the sheets Sb can be stably transferred to the sheet storing section 40 in the sheet discharging direction d2.

The stapling means 26 in this embodiment may be a common electrically-powered stapler which is generally incorporated in a sheet handling device of this sort, but not specifically peculiar. Instead of or in the company of such an electric stapler, a punching machine may be used.

The stapling means 26 is mounted at the front end of the sheet transferring reference surface 21*a* of the first storage means 21 relative to the sheet discharging direction d2. When the sheets Sb are transferred along the sheet transferring reference surface 21*a* by the transferring means 25, one or more staples are arbitrarily thrust into the margin part of the sheets Sb, which is in contact with the sheet transferring reference surface 21*a*.

Figure 3:
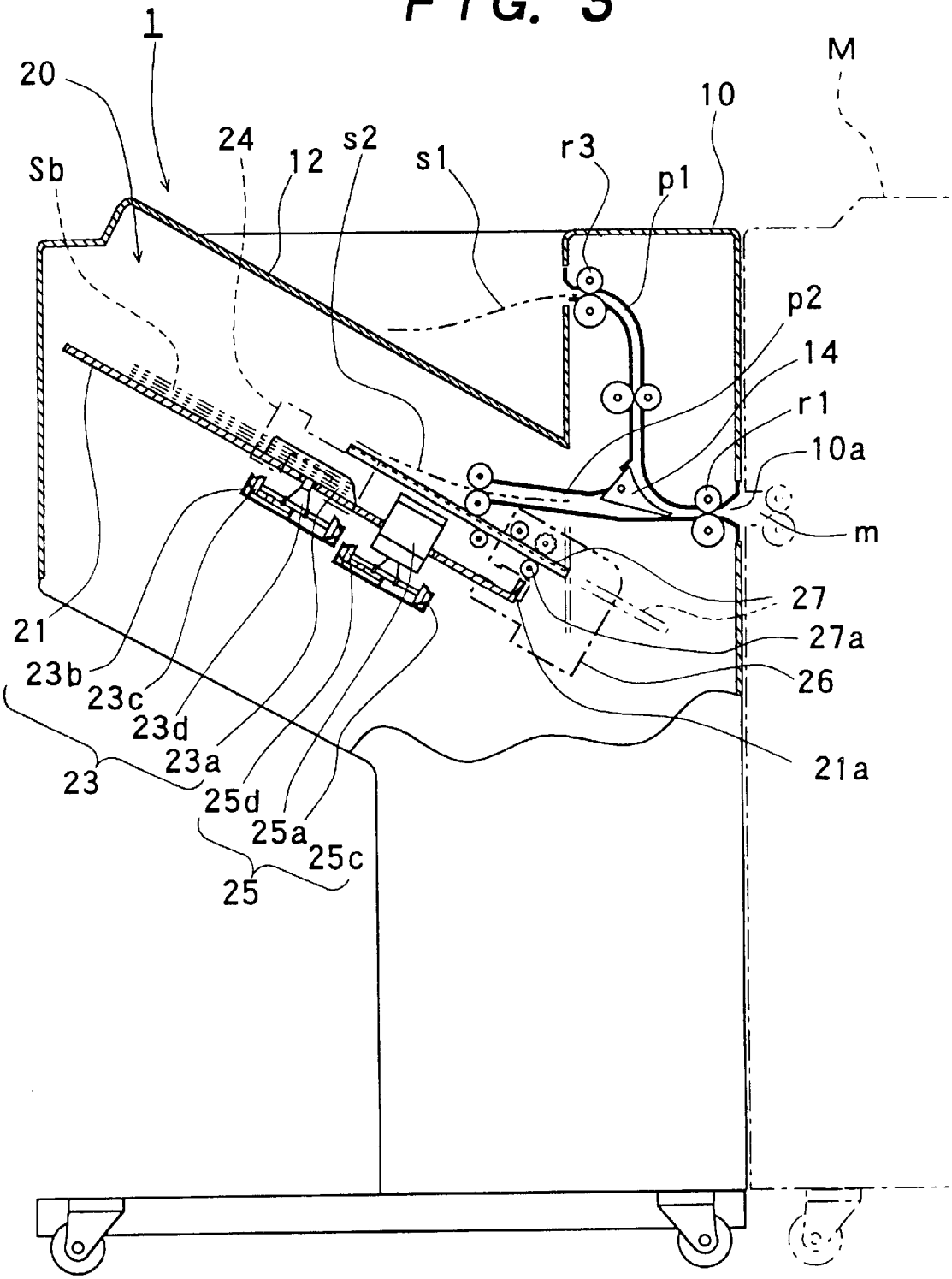
FIG. 3 is a schematic front section taken along the line III—III in FIG. 2.

In FIG. 3, denoted by 27 is a waiting tray for temporarily receiving a sheet for a succeeding sheaf of sheets, which is introduced from the image forming apparatus M into the sheet handling device, until the sheaf of sheets being processed on the first storage means 21 is completely sent out from the first storage means 21. The waiting tray for temporarily putting thereon the succeeding sheet on standby is not necessarily indispensable to the invention.

The waiting tray 27 is supported movably by holding rollers 27*a* so as to move in and out with respect to the sheet transferring reference surface 21*a* in the sheet introducing direction d1 in parallel to the first storage means 21. The waiting tray 27 is held on each side thereof by a three-point supporting mechanism comprising two lower rollers being in contact with the lower surface of the waiting tray and an upper roller being in contact with the upper surface of the waiting tray and located between the lower rollers. With this supporting mechanism, the waiting tray 27 is movable to and fro relative to the first storage means 21 at a fixed angle.

Figure 2:
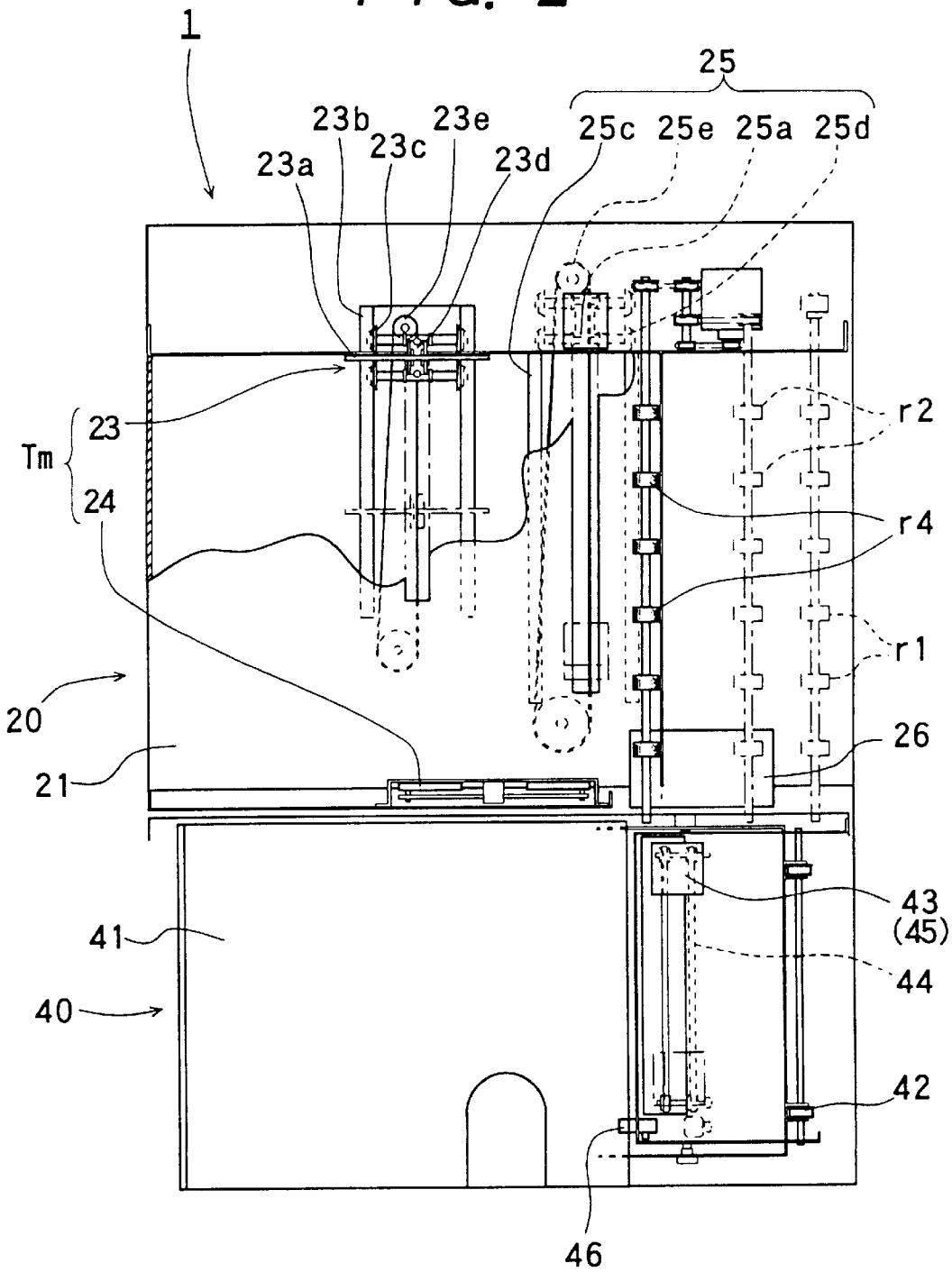
FIG. 2 is a schematic plan section showing the device of FIG. 1.
Figure 4:
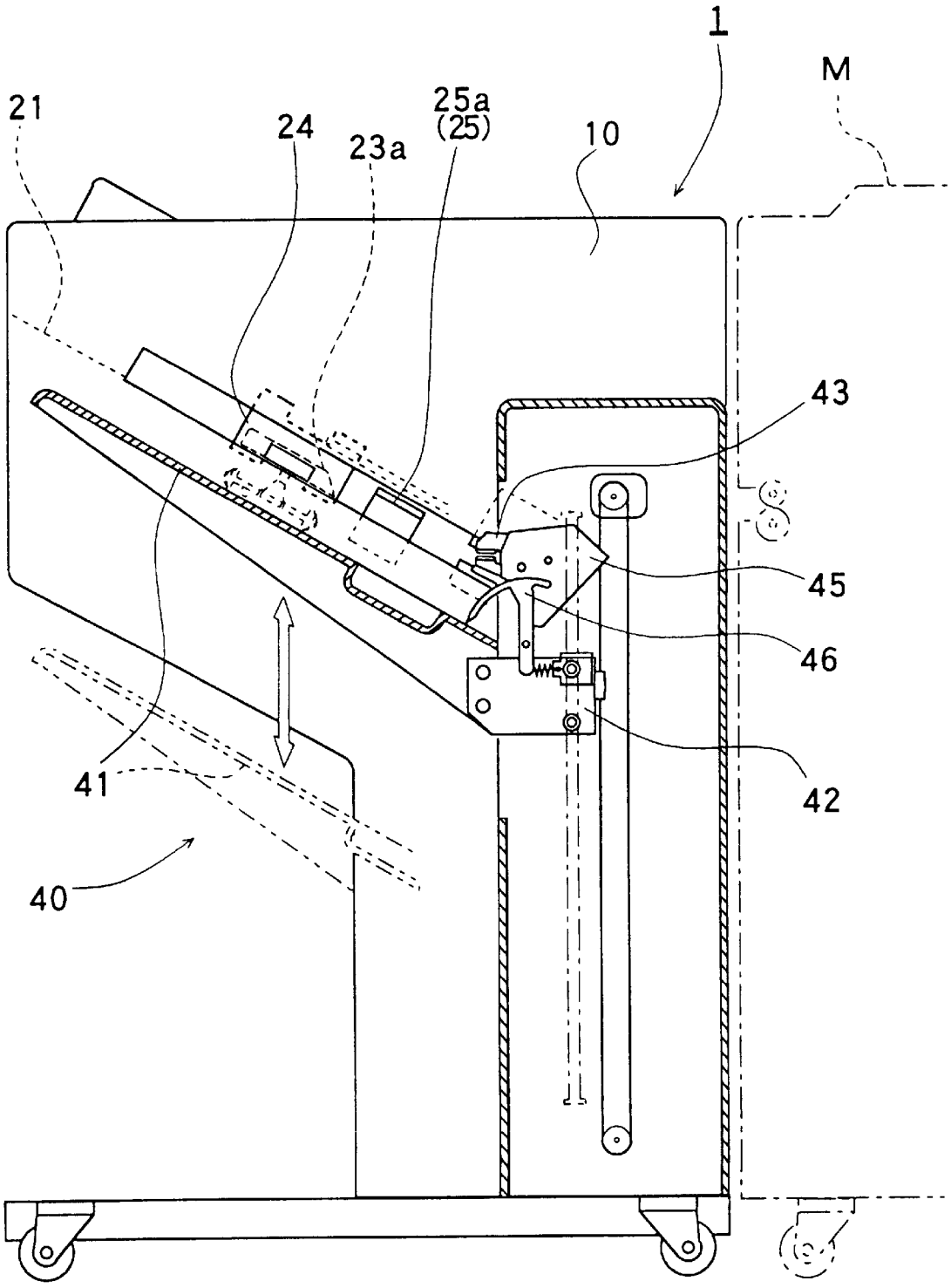
FIG. 4 is a schematic front section taken along the line IV—IV in FIG. 2.

The sheet storing section 40 comprises a second storage means 41 formed of a vertically movable stacking tray for stacking the sheaf of sheets Sb sent from the sheet processing section 20, lifting means 42 for moving vertically the second storage means 41, means 43 for gripping the sheets Sb sent from the sheet processing section 20 by the transferring means 25, means 44 for moving the gripping means 43 in the sheet discharging direction d2, tilting means 45 for vertically rocking the gripping means 43, and means 46 for detecting the height of sheaves of sheets stacked on the second storage means 41, as shown particularly in FIG. 2 and FIG. 4.

The sheets Sb, which are aligned and bound in the sheet processing section 20 and sent in the sheet discharging direction d2 to the sheet storing section 40, are taken into the second storage means 41 while being caught by the gripping means 43. Then, when the sheets Sb bound arrive just above the storing tray of the second storage means 41, they are released from the gripping means 43 so as to be landed on the storing tray of the second storage means 41.

The components constituting the sheet storing section 40 are by no means limited thereto and any other components may be adopted for stably transferring and landing the sheets on the second storage means.

The operation of the sheet aligning mechanism Tm in the aforenoted sheet handling device will be described with reference to FIG. 7A through FIG. 7C and FIGS. 8A and 8B.

Figure 8A:
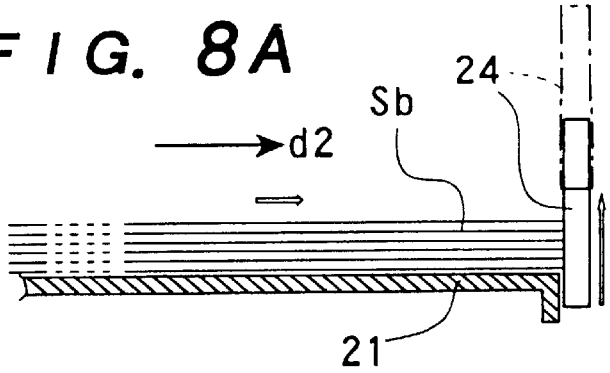
FIG. 8A and FIG. 8B are schematic front views showing the manner in which the front-side aligning member comes in contact with sheets.

In the initial state in which a sheet is introduced from the image forming apparatus to the first storage means 21 of the sheet processing section 20, the front-side aligning member 24 takes its lower aligning position to close the sheet transferring passage Px. Each time the sheet reaches the first storage means 21 or when a prescribed number of sheets are accumulated on the first storage means 21, the rear-side aligning member 23 is moved in the sheet discharging direction d2 to press the sheet or sheets against the front-side aligning member 24 as shown in FIG. 7A. Consequently, the sheets Sb are aligned in the sheet discharging direction d2 as shown in FIG. 8A.

Figure 7B:
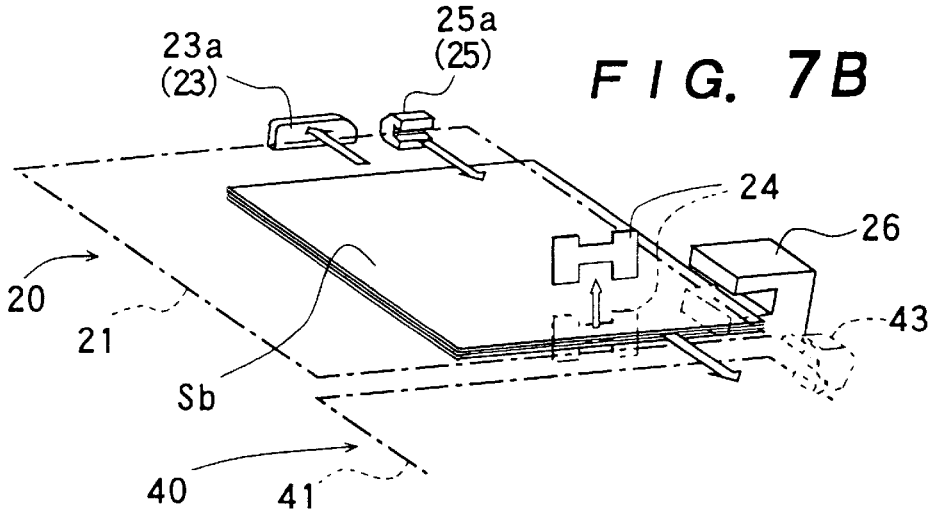

Upon completion of alignment of the sheets, the sheets Sb are forwarded by the transferring means 25 in the sheet discharging direction d2 and gripped by the gripping means 25*a*, and the front-side aligning member 24 is moved upward to open the sheet transferring passage Px as shown in FIG. 7B. Then, the transferring means 25 is moved forward in the sheet discharging direction d2, and meanwhile, the aligning operation member 23 of the rear-side aligning member is moved in the opposite direction to the sheet discharging direction d2, consequently to return to its initial position.

Figure 7C:
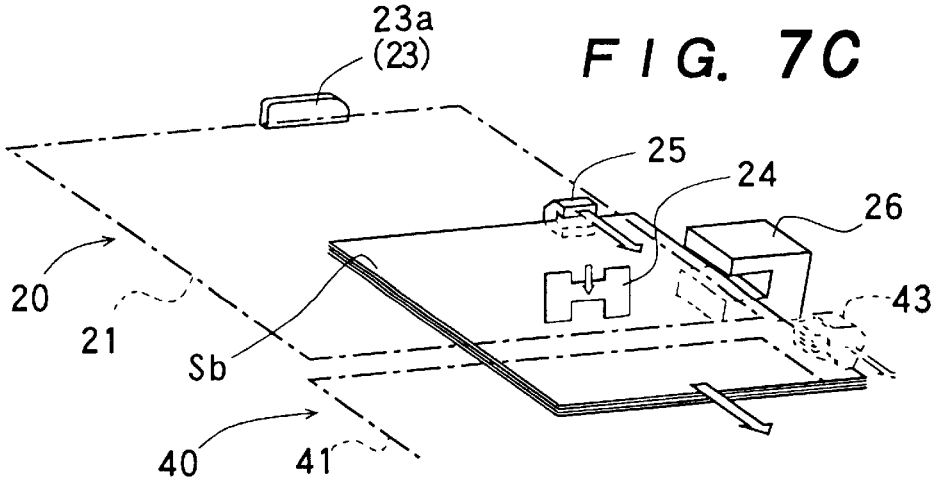
Figure 8B:
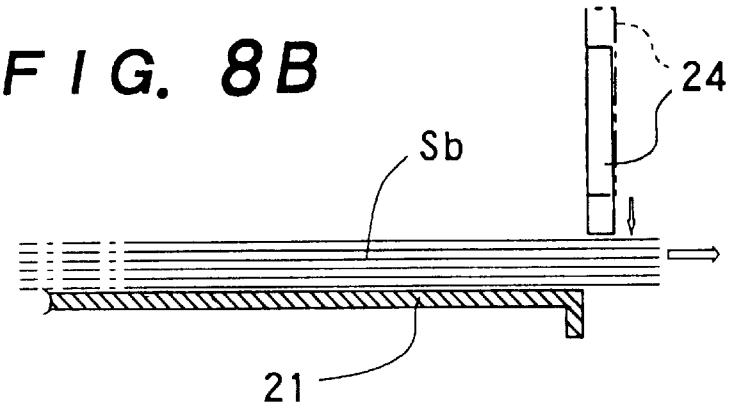

Just after the sheets Sb gripped by the gripping means 25*a* are transferred by the transferring means 25 in the sheet discharging direction d2, the front-side aligning member 24 is moved downward to come in slight contact with the upper surface of the sheets Sb as shown in FIG. 7C and FIG. 8B. Thus, the sheets Sb being transferred are softly depressed by the front-side aligning member 24, so that it can be stably forwarded in the sheet discharging direction d2 without straggling.

While the sheets Sb are transferred toward the sheet storing section 40, the sheets Sb are bound at one or more arbitrary points of the margin part of the sheaf of sheets with one or more staples ST by the stapling means 26.

The front-side aligning member 24 in the embodiment described above is movable vertically over the first storage means 21 as shown in FIG. 8A, while being rubbed with the leading ends of the sheets Sb aligned on the first storage means 21. As a result, it is feared that the front-side aligning member 24 fails to open certainly or makes fricative noises. Specifically in case of handling delicate sheets, they are apt to be damaged by friction.

Figure 9:
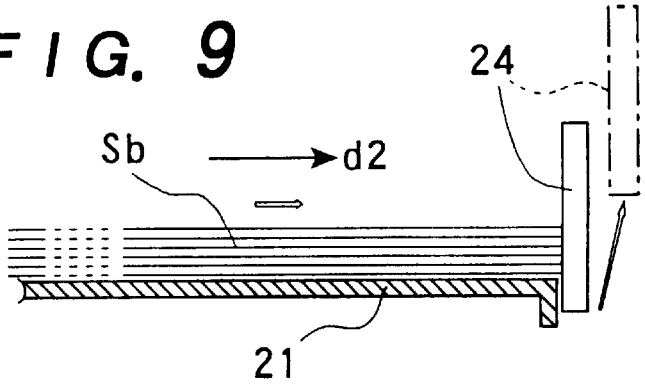
FIG. 9 is a schematic front view showing another operating mode of the front-side aligning member.

To prevent the front-side aligning member moving vertically from rubbing against the leading ends of the aligned sheets held on the first storage means, the front-side aligning member 24 may be lifted aslant forwardly relative to the sheet discharging direction d2, as indicated by the arrow d3 in FIG. 9.

Figures 10A, 10B:
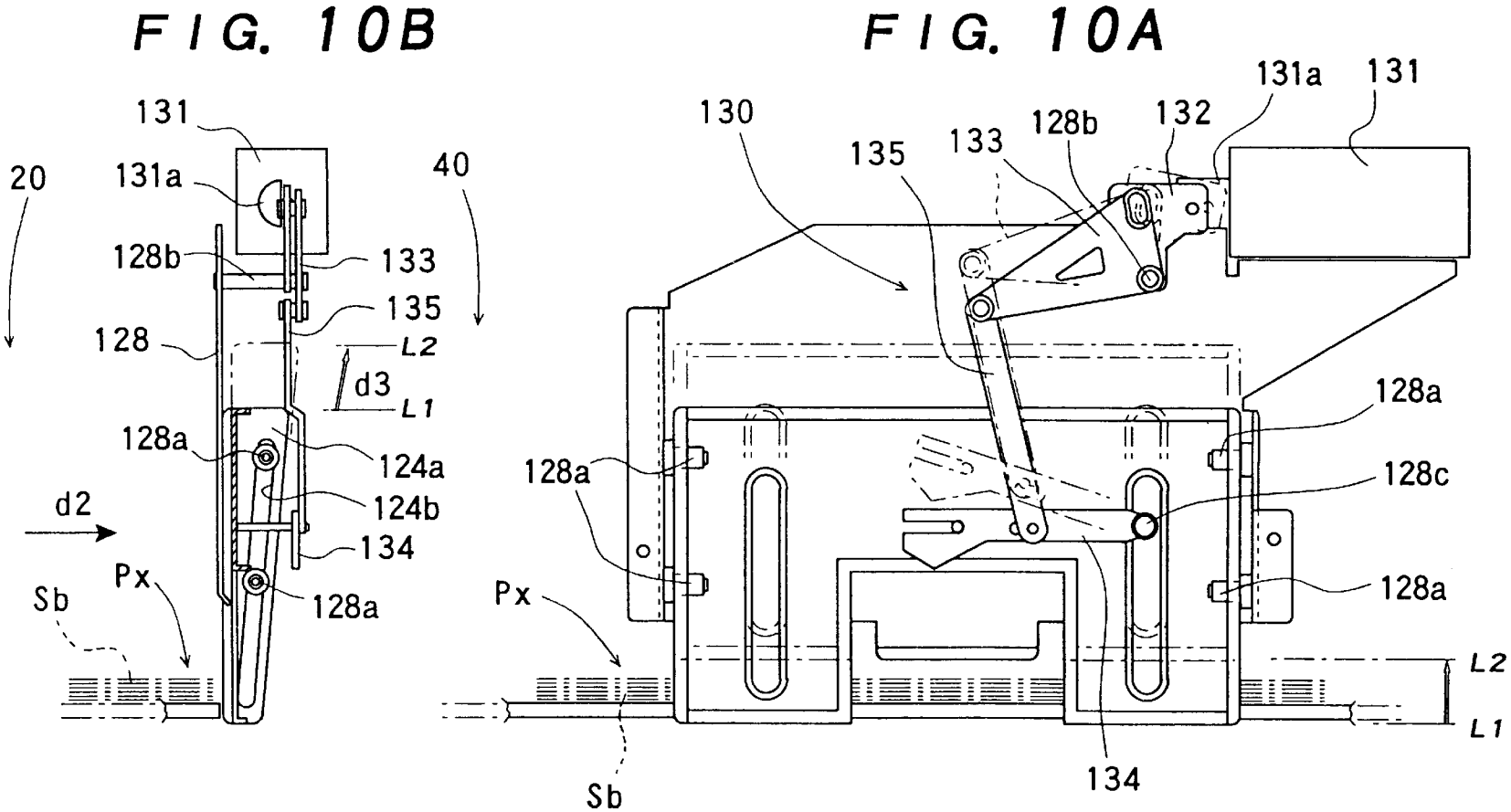
FIG. 10A and FIG. 10B are front and side sectional views showing a second embodiment of the front-side aligning member in this invention.

FIG. 10A and FIG. 10B illustrate another embodiment in which the front-side aligning member is withdrawn aslant.

The front-side aligning member 124 in this embodiment has side frames 124*a* each having a guide slot 124*b* inclined relative the the first storage means 21, and a stationary support frame 128 having guide pins 128*a* inserted into the guide slots 124*b*, so as to permit the front-side aligning member 124 to move aslant upward (in the direction of the arrow d3).

The front-side aligning member 124 in this embodiment is driven by driving means 130 which comprises a solenoid 131 having a pin 131*a*, a first work member 132 supported on a pivot 128*b*, a second work member 133 supported on the pivot 128*b*, and a rocking member 134 rockingly movable about a pivot 128*c*, and a link connecting the second work member 133 to the rocking member 134.

With the driving means 130, reciprocating motion produced by the solenoid 131 is transmitted to the front-side aligning member 124 through the pin 131*a*, first work member 132, second work member 133 and rocking member 134, to move the front-side aligning member 124 aslant upward. Therefore, even if the front-side aligning member 124 being in contact with the leading edges of the sheets Sb aligned on the first storage means is withdrawn upward, the front-side aligning member 124 does not rub against the sheets. Thus, inadequate opening movement of the shutter member 124, damage of the leading ends of the sheets and generation of fricative noises due to friction between the shutter member and the sheets can be eliminated.

Also in this embodiment, the front-side aligning member 124 can be in soft contact with the upper surface of the sheets Sb being just transferred under the front-side aligning member 124 so as to allow the sheets to stably move is without straggling.

Figure 11:
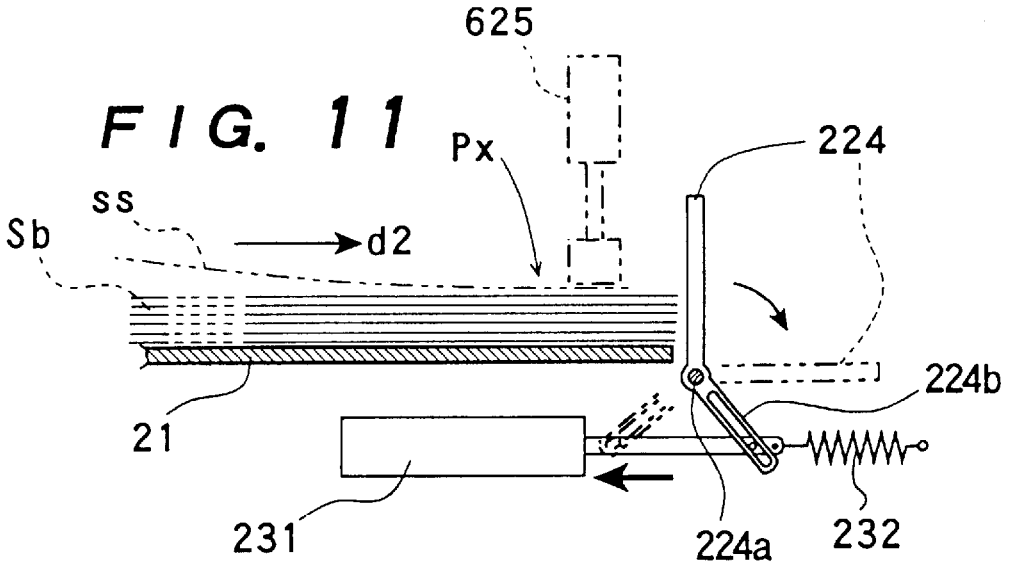
FIG. 11 is a schematic side view showing a third embodiment of the front-side aligning member.

As another measure for preventing the front-side aligning member from rubbing against the sheets aligned on the first storage means 21, the third embodiment shown in FIG. 11 may be adopted.

In the third embodiment, a front-side aligning member 224 is supported rotatably by a pivot 224*a* disposed at the front end of the first storage means 21 and has an operative slot lever 224*b* extending downward from the lower end thereof at which the pivot 224*a* is located. A driving means for rotating the front-side aligning member 224 includes a solenoid 231 linked to the operative slot lever 224*b*. The front-side aligning member 224 is constantly urged by a resilient means 232 such as a spring so as to close the sheet transferring passage Px defined on the first storage means 21.

By actuating the solenoid 231 to rotate the front-side aligning member 224 around the pivot 224*a*, the front-side aligning member 224 is withdrawn downward to open the sheet transferring passage Px, so that the sheets Sb are permitted to advance in the sheet discharging direction d2.

In order to prevent a succeeding sheet, which may possibly be fed onto the sheaf of sheets Sb stacked and aligned on the first storage means and partially overlay the sheaf of sheets stacked, from being sent out together with the sheaf of aligned sheets to be transferred toward the second storage means 41 along the sheet transferring passage Px, a restraining means 625 which comes in contact with the upper surface of the sheaf of aligned sheets or the succeeding sheet ss overlaying the aligned sheets may be arranged as shown in FIG. 11, so that the succeeding sheet overlaying the sheaf of sheets Sb can be securely kept from following the sheets Sb being sent out toward the second storage means.

Figure 12:
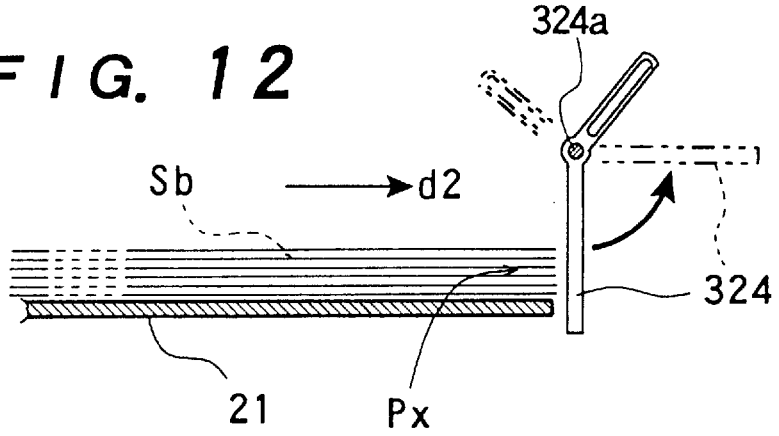
FIG. 12 is a schematic side view showing a fourth embodiment of the front-side aligning member.

The fourth embodiment shown in FIG. 12 has a front-side aligning member 324 supported openably upward by a pivot 324 disposed above the front end of the first storage means 21. A mechanism for opening the front-side aligning member 324 is substantially identical with that in the third embodiment described above.

Also in this fourth embodiment and other embodiments which will be described later, the restraining means 625 illustrated in FIG. 11 may preferably be added for preventing the succeeding sheet from following the sheaf of aligned sheets being sent out from the first storage means.

Figure 13:
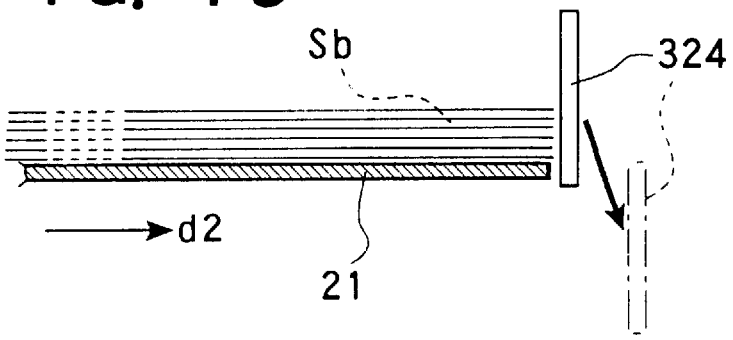
FIG. 13 is a schematic side view showing a fifth embodiment of the front-side aligning member.

FIG. 13 shows the fifth embodiment in which a front-side aligning member 424 is movable aslant downward relative to the sheet discharging direction d2. To this embodiment, the driving means used in the embodiment shown in FIG. 10A and FIG. 10B may be applied.

A front-side aligning member 524 in the sixth embodiment of FIG. 14 is supported rotatably by a pivot 531, so that it is opened upward and closed with a rotational motion which is produced by a rotary means such as a motor and transmitted to the pivot 531 through gears 533.

The first storage means 21 in this embodiment is inclined downward in the sheet discharging direction d2, so that the sheets Sb stacked on the first storage means 21 can spontaneously slide down to the second storage means 41. That is, when the front-side aligning member 524 is rotated upward to open the sheet transferring passage Px, the sheets Sb are automatically moved as free-falling from the first storage means 21 to the second storage means 41 without being forcibly pushed.

The seventh embodiment shown in FIG. 15A and FIG. 15B employs a front-side aligning member 624 which is movable in parallel in the sheet discharging direction (FIG. 15A) and can lay down forward (FIG. 15B) to open is the sheet passage. This mechanism is operated by driving means including a rotational source 630 such as a motor, and a transmission means formed of a gear 631 and a rack 632 for generating rectilinear motion from the rotational motion of the motor. The front-side aligning member 624 is linked to the rack 632 by a pivot 633 and has a lower protrusion 625 which collides with a fixed stopper 634 when moving forward.

Thus, the front-side aligning member 624 moves to and fro as it stands vertically until the lower protrusion 625 collides with the fixed stopper 634 (FIG. 15A). By further pushing the front-side aligning member 624 forward after bringing the lower protrusion 625 into collision with the fixed stopper 634, the front-side aligning member 624 rotates on the pivot 633 to open the sheet passage Px (FIG. 15B).

In FIG. 15B, the aligning position of the front-side aligning member 624 is depicted by a chain line, and the retreating position thereof is depicted by a solid line.

The embodiments described above are featured in that the sheets Sb fed onto the first storage means 21 are aligned by the sheet aligning mechanism Tm and sent out to the sheet storing section 40 upon opening the front-side aligning member, and besides, the front-side aligning member 124 is movable to open the sheet passage without rubbing against the leading end of the sheets. Thus, the front-side aligning member 124 can stably execute the opening action.

Although the sheet alignment is performed, in principle, by moving the rear-side aligning member toward the front-side aligning member 24 so as to press the sheets Sb against the front-side aligning member 24 in the foregoing embodiment as explained above, the sheets Sb handled in the seventh embodiment may be aligned by moving the front-side aligning member 624 backward in accordance of the size of the sheets fed from the image forming apparatus to the first storage means 21.

Figure 16A:
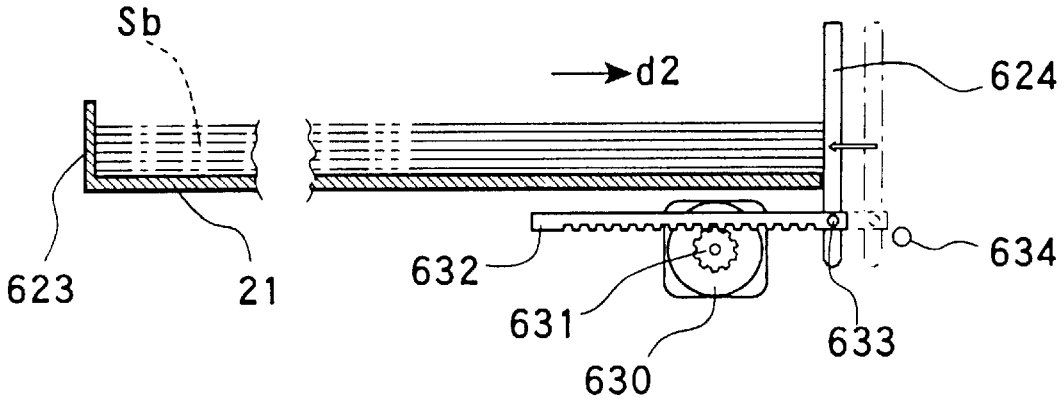
FIG. 16A and FIG. 16*b* are schematic side views showing an eighth embodiment of the front-side aligning member.
Figure 16B:
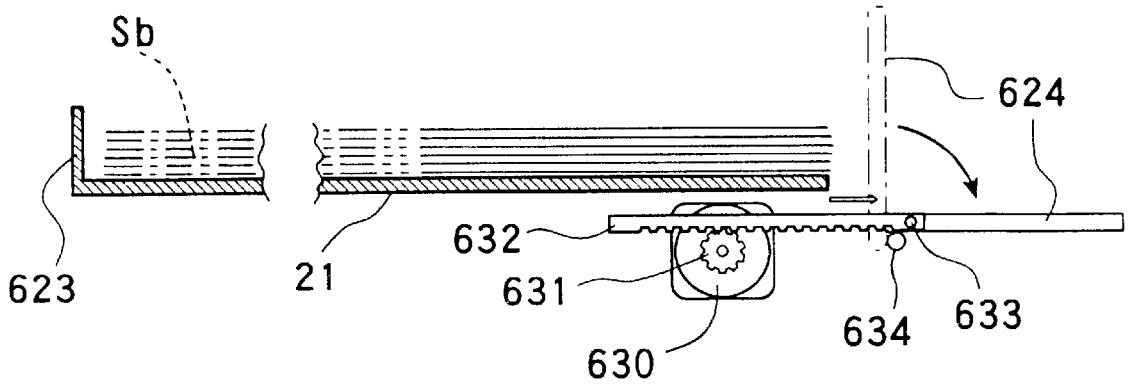

That is to say, as shown in FIG. 16A, the sheets Sb stacked on the first storage means 21 are pushed against the rear-side aligning member 623 by moving the front-side aligning member 624 backward. Consequently, the edges of the sheets are trued up in the sheet discharging direction d2, and thereafter, the front-side aligning member 624 is moved forward and rotated downward to open the sheet passage Px by being brought into collision with the fixed stopper 634.

As is apparent from the foregoing description, the sheet aligning mechanism in the sheet handling device according to the present invention brings about beneficial effects in that the sheets fed into the sheet processing section can be securely pressed between the rear-side aligning member movable to and fro in the sheet discharging direction and the front-side aligning member retractable from the sheet transferring passage Px, thus to be aligned exactly with high efficiency, and that the sheet handling device of the invention can be made small in size because the sheet aligning mechanism including the front-side aligning member does not occupy much space. Furthermore, since the sheets aligned in the sheet processing section by the sheet aligning mechanism are softly depressed by the front-side aligning member when being transferred to the sheet storing section, they are stably moved in the sheet discharging direction toward the sheet storing section without straggling.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sheet handling device comprising a first storage means for stacking one or more sheets having leading edges fed from an image forming apparatus thus forming a stack with a top surface, means for transferring the sheets stacked in said first storage means, a second storage means for storing the sheets transferred from said first storage means by said sheet transferring means, said second storage means being movable in a direction crossing transversely to said top surface of said sheets stacked on said second storage means, sheet aligning means to be brought into contact with said leading edges of said sheets for aligning the sheets stacked on said first storage means to true up said leading edges of said sheets, and moving means for causing said sheet aligning means to be movable between a sheet aligning position at which all of said sheets stacked on said first storage means are aligned by contacting leading edges of said sheets with said sheet aligning means and a retreating position apart from said sheet aligning position in a direction crossing transversely with a surface of said sheets stacked on said first storage means, said sheet aligning means being movable and thereby separated from said leading edges of said sheets stacked on said first storage means in a sheet discharging direction in which said sheets are transferred by said sheet transferring means.

2. A sheet handling device as claimed in claim 1, wherein said sheet aligning means is moved by said moving means in a direction crossing with a surface of said sheets stacked on said first storage means, while being withdrawn from said leading edges of said sheets in said sheet discharging direction.

3. A sheet handling device as claimed in claim 1, wherein said sheet aligning means is moved by said moving means in a direction crossing with a surface of said sheets stacked on said first storage means, after being withdrawn from said leading edges of said sheets in said sheet discharging direction.

4. A sheet handling device as claimed in claim 1, wherein said sheet aligning means is rotated by said moving means in a direction in which said aligning means is separated from said leading edges of said sheets in said sheet discharging direction, to move to said retreating position.

5. A sheet handling device as claimed in claim 1, wherein said sheet aligning means is retractable aslant upward or downward from said leading edges of said sheets.

6. A sheet handling device as claimed in claim 1, wherein said sheet aligning means is retractable aslant upward from said leading edges of said sheets and subsequently to retracting aslant upward temporarily comes into contact with said top surface of said sheets being transferred.

7. A sheet handling device comprising a first storage means for stacking one or more sheets having leading edges fed from an image forming apparatus thus forming a stack with a top surface, means for transferring the sheets stacked on said first storage means, a second storage means for storing the sheets transferred from said first storage means by said sheet transferring means, said second storage means being movable in a direction crossing transversely to said top surface of said sheets stacked on said second storage means, and front-side and rear-side aligning members disposed in front of and behind the sheets stacked on said first storage means, said front-side aligning member being movable between a sheet aligning position at which all of said sheets stacked on said first storage means are aligned by contacting leading edges of said sheets with and a retreating position apart from said sheet aligning position in a direction crossing transversely with said top surface of said sheets stacked on said first storage means, said front-side aligning member being movable and thereby separated from said leading edges of said sheets stacked on said storage means in a sheet discharging direction in which said sheets are transferred by said sheet transferring means.

8. A sheet handling device as claimed in claim 7, wherein said sheet aligning means is movable by said moving means in a direction crossing transversely with said top surface of said sheets stacked on said first storage means, while being withdrawn from said leading edges of said sheets in said sheet discharging direction.

9. A sheet handling device as claimed in claim 7, wherein said front-side aligning member is movable in a direction crossing transversely with a surface of said sheets stacked on said first storage means, after being withdrawn from said leading edges of said sheets in said sheet discharging direction.

10. A sheet handling device as claimed in claim 7, wherein said front-side aligning member is rotated in a direction in which said front-side aligning member is separated from said leading edges of said sheets in said sheet discharging direction, to move to said retreating position.

11. A sheet handling device as claimed in claim 7, wherein said rear-side aligning member is movable toward said front-side aligning member to align the sheets stacked between said front-side aligning member and said rear-side aligning member.

12. A sheet handling device as claimed in claim 7, wherein said front-side aligning member is movable toward said rear-side aligning member to align the sheets stacked between said front-side aligning member and said rear-side aligning member.

13. A sheet handling device as claimed in claim 7, wherein said front-side aligning member is movable to be separated from the sheets aligned between said front-side and said rear-side aligning members upon moving said rear-side aligning member backward, to transfer the aligned sheets by said sheet transferring means.

14. A sheet handling device comprising a first storage means for storing a stack of one or more sheets having leading edges fed from an image forming apparatus thus forming a stack with a top surface, means for transferring the sheets stored in said first storage means, a second storage means for storing the sheets transferred from said first storage means by said sheet transferring means, said second storage means being movable in a direction crossing transversely with said top surface of said sheets stacked on said second storage means, and means for restraining a succeeding sheet overlaying said stack of sheets to be transferred from said first storage means toward said second storage means by said transferring means.

15. A sheet handling device as claimed in claim 14, further comprising means for aligning the sheets stacked on said first storage means by coming into contact with said leading edges of said sheets, and moving means for separating said sheet aligning means from said leading edges of said sheets stacked on said first storage means in a sheet discharging direction when transferring said sheets.

16. A sheet handling device as claimed in claim 14, further comprising operating means for causing said restraining means to retreat from its aligning positions at which the sheets are aligned, thus to prevent said succeeding sheet fed onto said stack of aligned sheets being sent out from said first storage means.

17. A sheet handling device as claimed in claim 14, further comprising means for aligning the sheets stacked on said first storage means, said aligning means being movable from its sheet aligning position to its retreating position and coming into contact with an upper surface of the sheets being transferred by said transferring means.

* * * * *